US007061400B2

(12) United States Patent
Vet

(10) Patent No.: US 7,061,400 B2
(45) Date of Patent: Jun. 13, 2006

(54) PROGRAMMABLE POSITIONING AND TELEMETRIC SYSTEM, TRANSMITTER AND PROGRAMMING STATION AND METHOD OF OPERATING SUCH

(75) Inventor: Jan Vet, Waalre (NL)

(73) Assignee: Sensite Solution, B.V., Eindhoven (NL)

( * ) Notice: Subject to any disclaimer, the term of this patent is extended or adjusted under 35 U.S.C. 154(b) by 111 days.

(21) Appl. No.: 10/759,777

(22) Filed: Jan. 16, 2004

(65) Prior Publication Data

US 2004/0207536 A1 Oct. 21, 2004

(30) Foreign Application Priority Data

Jan. 20, 2003 (NL) ..... 1022434

(51) Int. Cl.
*G08C 19/22* (2006.01)

(52) U.S. Cl. ..... 340/870.16; 340/539.19; 340/870.09

(58) Field of Classification Search ..... 340/539.1, 340/573.1, 573.3, 573.4, 502, 506, 522, 309.16, 340/870.09, 870.19, 539.19, 870.16; 375/221; 370/348

See application file for complete search history.

(56) References Cited

U.S. PATENT DOCUMENTS

| | | | | |
|---|---|---|---|---|
| 5,025,492 | A * | 6/1991 | Viereck | 342/44 |
| 5,034,997 | A * | 7/1991 | Iwasaki | 398/115 |
| 5,572,546 | A * | 11/1996 | Serfaty et al. | 375/221 |
| 5,650,770 | A | 7/1997 | Schlager et al. | 340/573.1 |
| 6,901,066 | B1 * | 5/2005 | Helgeson | 370/348 |

FOREIGN PATENT DOCUMENTS

EP 0 357 309 A 3/1990

* cited by examiner

*Primary Examiner*—Van T. Trieu
(74) *Attorney, Agent, or Firm*—Fenwick & West LLP

(57) ABSTRACT

A tracking and telemetry system includes at least one transmitter and at least one receiver. The at least one transmitter is arranged for transmitting a first or identification signal according to a time schedule, and the at least one receiver is arranged for receiving the transmitted first signal. The at least one transmitter is arranged for receiving a second or programming signal and setting or adapting or otherwise altering the time schedule for the transmission of the first signal in response to the second signal. Furthermore, there are provided a transmitter and a programming station arranged for setting or adapting or otherwise altering the time schedule in response to said second signal.

18 Claims, 2 Drawing Sheets

PROGRAMMABLE POSITIONING AND TELEMETRIC SYSTEM, TRANSMITTER AND PROGRAMMING STATION AND METHOD OF OPERATING SUCH

FIELD OF THE INVENTION

The invention relates to a tracking and telemetry system, comprising at least one transmitter and at least one receiver, which at least one transmitter is arranged for transmitting a first signal according to a time schedule, and which at least one receiver is arranged for receiving the transmitted first signal.

The invention also relates to a method for programming a tracking and telemetry system comprising at least one transmitter and at least one receiver, which at least one transmitter is arranged for transmitting a first signal according to a time schedule, and which at least one receiver is arranged for receiving the transmitted first signal.

The invention furthermore relates to a transmitter and to a programming station for use with such a tracking and telemetry system.

BACKGROUND OF THE INVENTION

A tracking and telemetry system is known from European patent application EP 0 357 309, which discloses a tracking and telemetry system for tracking personnel in a building or on an industrial estate. The document discloses a tag which can be worn by an employee, which tag periodically transmits a signal that can be received by a field monitoring device (FMD). The tag is capable of generating the signals periodically, wherein the periodicity of the signal can be set by a control module.

One drawback of the device disclosed in EP 0 357 309 is the fact that it is not easy, when in use, to adjust the periodicity to the conditions as they occur. The behaviour of the transmitter is determined by the control module, and consequently said behaviour can only be fixed by programming the control module. This needs to be done for each transmitter individually. In addition, collective adaptation of the behaviour of a multitude of transmitters is not possible.

Such tracking and telemetry systems are furthermore used for tracking, following and/or checking persons or objects in various situations. Examples of this are the geographic monitoring of persons, for example at home, at a home for the elderly or at school, the tracking down of roll containers in a warehouse, the guarding of objects, such as a bicycle, or the monitoring of the state of health of patients in hospital.

A transmitter attached to an object or worn by a person, also referred to as "tag" in English professional literature, transmits a transmitter-identifying signal according to a time schedule, for example periodically, which signal can be received by one or more receivers. The position of the transmitter, or of the object or the person wearing the transmitter, can e.g. be located or tracked, or a particular event can be signalised, for example by delivering an alarm signal in emergency situations or the like.

Locating or tracking the transmitter may be done by means of a positioning technique, using triangulation, in which the location of the transmitter can be computed from the signal received by three or more receivers and their (relative) geographic positions.

Additional information about the object or the person in question may be added to the first signal that is to be transmitted by the transmitter. For example, if the transmitter that is worn by a person is operatively connected to or fitted with a temperature sensor, it will be possible at all times to provide up-to-the-minute information about said person's body temperature. Other applications in this connection are e.g. the registration of the blood pressure, of the heartbeat, of a person or an object falling, of the humidity level, etc., providing that the transmitter is operatively connected to and/or fitted with suitable sensors or input means. When a predetermined limiting value is exceeded, an alarm signal may be automatically generated by the receiver, for example.

Active transmitters usually transmit an identification signal, which is typically detectable over a few hundred metres. The transmitter needs to have its own power supply source, such as a battery, for supplying the energy that is required for that purpose. An important problem in this regard is the life of the battery. In systems that are used in practice, the (service) life of the battery is only about three years in the case of normal use, such as the transmission of an identification signal at intervals of e.g. a few seconds, whilst most applications require a much longer (service) life, e.g. 10 years.

U.S. Pat. No. 5,650,770 discloses a personal alarm system, comprising a transmitter which transmits a signal that can be received by a receiver. The personal alarm system also comprises a number of different sensors, by means of which environmental parameters, such as the presence of smoke, water, high temperatures, carbon monoxide etc. can be measured, and the status of the label and/or the signal can be adjusted on the basis thereof. U.S. Pat. No. 5,650,770 in particular makes mention of the possibility of adjusting the strength of the signal in dependence on the distance between the transmitter and the receiver with a view to saving battery power.

Collective adjustment of the transmitters in this tracking and telemetry system is not possible, whilst it is furthermore necessary for each transmitter to be programmed individually.

SUMMARY OF THE INVENTION

According to a first aspect of the present invention, this object is accomplished in that the transmitter is furthermore arranged for receiving a second signal and setting and/or adapting the time schedule for the transmission of the first signal in response to said second signal.

The invention is based on the perception that the energy consumption of the transmitter is to a large extent determined by the transmission behaviour thereof, in particular the transmission of the first signal (or identifying signal) thereof. Consequently, the solution according to the invention provides a possibility of controlling the time schedule for the transmission of the first signal for the purpose of optimally setting or adapting said schedule to the circumstances, such as a specific function for which the tracking and telemetry system is being used.

According to the invention, the first signal (or identifying signal) to be transmitted by the transmitter can be set to be transmitted per unit of time, such as the hour of the day or the day of the week, etc., for a specific use, by providing a suitable second signal. If desired, the time schedule for the transmission of the first signal can be dynamically adapted by providing a suitable continuous or quasi-continuous second signal.

The required time schedule is strongly dependent on the purpose for which the system is being used. In the case of an alarm function, for example, the pressing of an alarm button may trigger the transmission of the identification signal, whilst identification of the transmitter is not at all needed as long as the alarm button is not operated. Another example is the use of such a system in a warehouse or distribution centre, in which roll containers are e.g. fitted with transmitters. When the roll container is stationary, the transmission of a slow identification or beacon signal, e.g. at intervals of a few minutes, will be functional. As soon as the roll container starts to move, however, the frequency with which the beacon signals or identification signals are transmitted must be much higher, e.g. once every second.

Such time schedules are stored in the transmitter, and they determine the transmission behaviour of the transmitter. In the present invention, such a stored time schedule may be continuously adapted to the present requirements. Not only is the energy consumption of the transmitter optimised in this way, but in addition the transmitter can readily be used or reused for various purposes at the same time.

It will be understood that the energy consumption of the transmitter can be suitably controlled via the second signal both statically and dynamically, geared to and in dependence on the situation in question. Since the energy consumption can be continuously adapted to the current situation, the transmitter will only consume so much energy as is actually needed for the current use, thus making it possible to realise the intended extension of the service life of the battery.

In one embodiment of the invention, the tracking and telemetry system comprises means for wireless transfer of the second signal to said at least one transmitter. For practical and economic reasons, and in order to be able to keep the transmitters sufficiently small, wireless transfer is preferred to transfer via cables and connectors.

If said second signal is a radio signal, said at least one transmitter comprises a resonance circuit arranged for receiving the radio signal. Such a resonance circuit is very easy to incorporate in the transmitter, and in addition it can be tuned to a desired transmission frequency for receiving the second signal at a carrier frequency (approximately) identical to said resonance frequency.

In another embodiment of the present invention, said at least one transmitter comprises a plate with printed wiring present thereon, also called printed circuit board, and the resonance circuit comprises a coil which is formed by a conductive track on said printed circuit board. Such a coil is easy to manufacture and provides a very efficient and cost-effective circuit.

In a preferred embodiment of the present invention, the transmitter of the tracking and telemetry system according to the invention comprises a transistor which is operatively connected to the resonance circuit and which is arranged for generating signal pulses in the transmitter upon receipt of the second signal, which signal pulses are used for setting and/or adapting the time schedule.

By connecting the resonance circuit to a transistor, the transistor can be switched to its conducting state upon receipt of the second, signal, and it can also be used as a rectifier, for example for generating voltage pulses by means of which information can be transferred, for example to active elements in the transmitter, such as a microprocessor, for the purpose of setting the time schedule.

According to a second aspect of the invention, a separate programming station is provided for producing said second signal, which programming station may be arranged for statically and/or dynamically adapting the time schedule in a transmitter.

The cost of the transmitters and the receivers to be used in the system according to the present invention can be optimised, geared to the desired use of the system as a tracking and telemetry system, by incorporating the function of producing the second signal in a separate programming station.

In another embodiment of the present invention, the programming station is arranged for wireless transfer of the second signal to the transmitter, with the transmitter being arranged for wireless reception of the second signal, such as a radio signal, as discussed above.

The advantage of said wireless transfer and reception of the second signal by the programming station and the transmitter, respectively, is that it is not necessary to provide a physical connection between the transmitter and the programming station for programming the time schedule of the transmitter. This means a significant simplification of the use of the system.

According to a third aspect, the present invention provides a transmitter for use in a tracking and telemetry system according to the first aspect of the invention as described above.

According to a fourth aspect, the present invention provides a method for setting and/or adapting or programming the time schedule in a transmitter in a tracking and telemetry system by suitably generating and delivering a second signal.

BRIEF DESCRIPTION OF THE DRAWINGS

The invention will now be explained in more detail by means of a description of non-limitative embodiments thereof, in which reference is made to the appended drawings, in which.

DETAILED DESCRIPTION OF THE INVENTION

Figure 1:
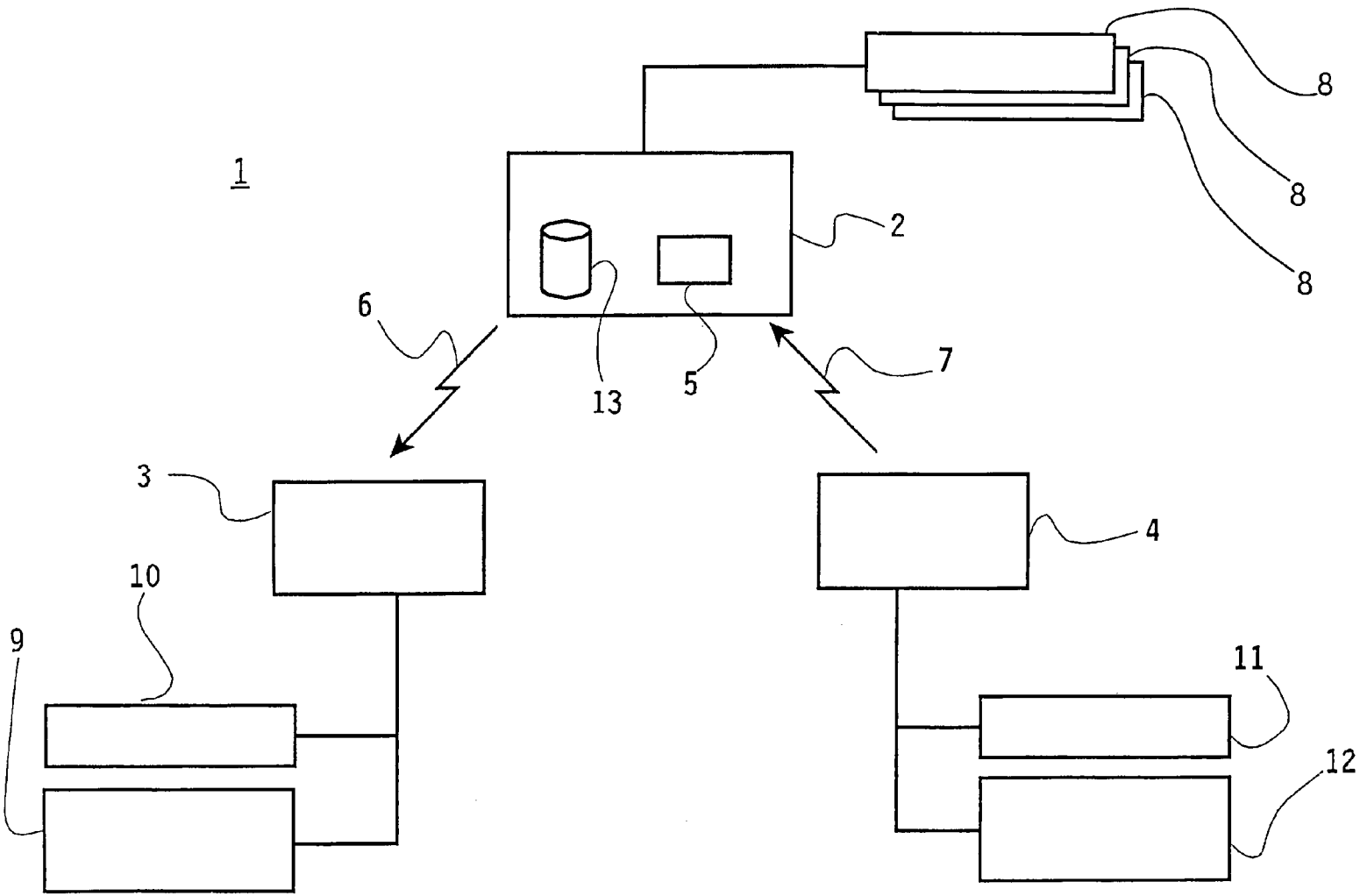
FIG. 1 schematically shows a tracking and telemetry system according to the present invention.

In FIG. 1, a programmable tracking and telemetry system 1 according to the present invention is shown in a very schematic representation thereof. The system comprises at least one transmitter 2, at least one receiver 3 and a programming station 4. The transmitter 2 may in fact have any form geared to a specific use thereof.

The transmitter 2 comprises means for transmitting a first signal 6. for example in the form of a transmission signal generating circuit. The receiver 3 furthermore comprises means for receiving the first signal 6, for example in the form of a receiver circuit. In order not to complicate the description of the invention unnecessarily, elements that are not necessary for a correct understanding of the present invention by those skilled in the art, such as transmission signal generating circuits, receiver circuits etc., will not be further described herein.;

In use, the transmitter 2 transmits the first signal (or identification signal) 6 according to a time schedule 5, which is e.g. stored in a memory (not shown) of the transmitter 2, which memory may or may not be linked with a control processor 14, which signal is received by one or more receivers 3. The transmitter 2 may furthermore be operatively connected to or be provided with input means 8, among which a thermocouple, an (air) humidity sensor, a sphygmometer or pulsometer, a motion sensor, an alarm button or other suitable sensors. The first signal may provide information which the transmitter 2 has obtained from the input means 8.

The receiver 3 for example comprises display and notification means 9 and, if desired, input and/or control means 10, for example for controlling the behaviour of the receiver 3, such as the fixing of limiting values of received signals in response to which an action must be undertaken, such as the delivering of an alarm signal or the like.

The programming station 4 is capable of producing a second signal (or programming signal) 7 by means of a transmission signal generating circuit, which signal can be received by the transmitter 2. To that end the transmitter 2 furthermore comprises means for receiving the second signal. According to the invention, said programming signal 7 is arranged for programming the transmission behaviour of the transmitter 2, such as (adaptations to) the time schedule 5 for transmitting the first signal (or reference signal) 6. To that end, the time schedule stored in the control processor is adapted in the transmitter 2 in response to the second signal.

The programming station 4 is operatively connected to (or provided with) input means 11 for specifying the transmission behaviour of the transmitter 2, by a user or otherwise, and to display and notification means 12, e.g. for acknowledging or denying the correct receipt of a programming signal 7. To that end, the programming station may be advantageously provided with its own receiver means, such as a receiver 3, for receiving a first signal (or reference signal) 6 transmitted by the transmitter 2, inter alia for test and verification purposes.

In a preferred embodiment of the invention, the transmitter 2, the receiver 3 and the programming station 4 are arranged for wireless transfer of the first and the second signal 6, 7 by radiographic means. Wireless transfer of the signals 6, 7 may also take place by optical or ultrasonic means or in any other suitable manner as known per se to those skilled in the art.

The second signal or programming signal 7 may also be exchanged with the transmitter 2 by wire connection, using suitable connector connections.

In a further embodiment, the time schedule 5, which is stored in the means for adapting and storing the time schedule (or the control processor, with which the memory may be linked), may be adapted in dependence on the information provided by the input means. Thus, a multitude of transmitters may be programmed to transmit the first signal more frequently if the ambient temperature is higher than −4° C., for example if the transmitters are connected to roll containers which are present in a cold store, on which containers perishable foodstuffs are stored. If a user of the system wishes to alter the time schedule, for example because the cold store is defective, so that the temperature is continuously higher than 4° C., or because the roll containers have been emptied and are not present in the cold store, the user can transmit a second signal via the programming station 4 to set the same time schedule for temperatures above 4° C. and below 4° C. In this way the user can programme a single roll container individually, or a group of roll containers, or all roll containers, collectively.

The programming station 4 may be arranged for continuous or quasi-continuous transmission of a second signal (or programming signal) 7, partially in dependence on the complexity of and/or the possibilities of storing a refined time schedule in the transmitter 2. In a fairly simple embodiment of the invention, the programming station transmits a signal 7 geared to, for example, the time of the day, or the week or the month, for controlling the transmission behaviour of the transmitter 5 and thus the amount of electric energy that is withdrawn from a power supply source, such as a battery 13, in the transmitter 2.

Figure 2:
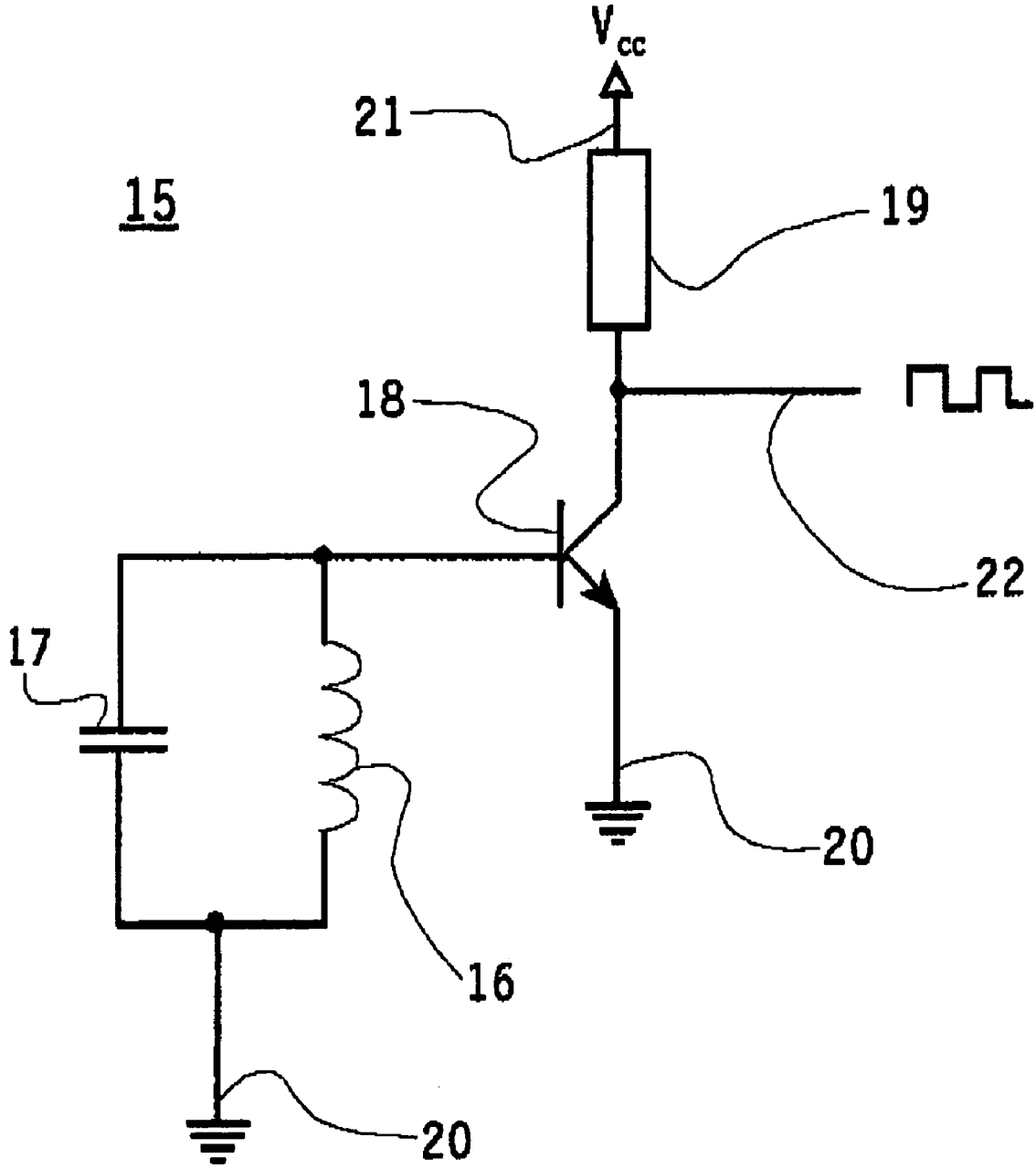
FIG. 2 shows part of a circuit of the transmitter for use in the present invention, said part in particular being the part intended for receiving the second signal.

FIG. 2 shows the receiver part 15 of a circuit of a transmitter 2 in a tracking and telemetry system 1 according to the present invention, which receiver part functions to receive a second signal 7 being transmitted by radiographic means.

In said part, a coil 16 and a capacitor 17 jointly form a resonance circuit (LC parallel circuit), which is connected to the signal earth 20 of the circuit 15 on one side and to the basis of a bipolar NPN transistor 18 on the other side. The emitter of the transistor 18 is connected to the signal earth 20, and the collector is connected to the positive power supply terminal Vcc 21 of the battery 13 via a resistor 19 (see FIG. 1). Furthermore, the collector of the transistor 18 forms an output 22 for connecting an active element for storing or updating the time schedule 5 (see FIG. 1), such as a microprocessor or a programmable memory.

The resonance circuit formed by the coil 16 and the capacitor 17 is tuned to a carrier frequency of a programming signal 7 transmitted by the programming station 4. Upon receipt of said programming signal 7 by the resonance circuit, a control signal is generated on the base connector of transistor 18, by means of which the transistor 18 will be periodically switched to a conducting state. Since the transistor 18 will only conduct in one direction, voltage pulses are formed on the collector of the transistor 18, at the output 22, which voltage pulses are to be supplied to the active element (not shown).

Said pulses contain the information by means of which the time schedule 5 of the transmitter 2 can be stored or adapted for fixing or adapting the transmission behaviour of 6 of the transmitter 2. Processing of the pulses may either take place under the control of hardware or under the control of software.

The power consumption of the circuit 15 for receiving the second signal (or programming signal) 7 is very small, less than 15 nA (nominal), so that the circuit does not stand in the way of achieving a longer service life of the battery 13. Furthermore, the coil 16 is preferably embodied as a conductor on a printed circuit board (not shown), so that a very small, efficient and cost-effective circuit 15 is obtained.

The carrier frequency of the programming signal 7 of the programming station 4 may e.g. be 13.56 MHz.

The embodiments that are shown in the figures are only shown by way of illustration of the system according to the invention as described herein. Thus, the PNP transistor 18 may also be an NPN-type transistor or e.g. a field effect transistor (FET).

The system according to the invention, in particular the transmitter thereof, may advantageously be used in combination with the system described in the patent application "Tracking and telemetry system comprising an input means-controlled transmission behaviour, as well as a transmitter and a method", as filed simultaneously with the present patent application by the present Applicant.

It will be understood, therefore, that the embodiments as shown and described herein are by no means intended to limit the invention in any way.

SURVEY OF REFERENCE NUMERALS

1. Tracking and telemetry system
2. transmitter(s)
3. receiver(s)
4. programming station

5. time schedule
6. first signal (or identification signal)
7. second signal (or programming signal)
8. input means
9. display and notification means
10. input and/or control means
11. input means
12. display and notification means
13. battery
14. means for adapting and storing the time schedule
15. receiver part of the transmitter (2)
16. coil
17. capacitor
18. transistor
19. resistor
20. signal earth
21. positive power supply terminal
22. output
23. means for transmitting the first signal
24. means for receiving the first signal
25. means for transmitting the second signal
26. means for receiving the second signal

The invention claimed is:

1. A tracking and telemetry system, comprising at least one transmitter and at least one receiver in which at least one transmitter is arranged for transmitting an identification signal according to a time schedule, and in which at least one receiver is arranged for receiving the transmitted identification signal, wherein the transmitter is arranged for receiving a programming signal for altering the time schedule for the transmission of the identification signal in response to said programming signal and wherein said programming signal is dependent on the use conditions of said tracking and telemetry system.

2. A tracking and telemetry system according to claim 1, further comprising means for wireless transfer of the programming signal to said at least one transmitter.

3. A tracking and telemetry system according to claim 2, wherein said at least one transmitter comprises a resonance circuit arranged for receiving said programming signal, and wherein said programming signal is a radio signal.

4. A tracking and telemetry system according to claim 3, wherein said transmitter furthermore comprises a printed circuit board, and wherein said resonance circuit comprises a coil which is formed by a conductive path on said printed circuit board.

5. A tracking and telemetry system according to claim 3, wherein the transmitter furthermore comprises a transistor which is operatively connected to the resonance circuit and which is arranged for generating signal pulses upon receipt of the programming signal, which signal pulses alter the time schedule in the transmitter.

6. A tracking and telemetry system according to claim 2 further comprising a programming station for producing said programming signal, wherein the programming station is arranged for wireless transfer of the programming signal to the transmitter.

7. A tracking and telemetry system according to claim 1, further comprising a programming station for producing said programming signal.

8. A tracking and telemetry system according to claim 1, wherein the transmitter comprises one or more input means selected from sensors and alarm signal generators for adding information provided by said input means to said identification signal.

9. A tracking and telemetry system according to claim 8, wherein the transmitter is further arranged for adapting the time schedule in dependence on the information provided by the input means.

10. A transmitter for use in a tracking and telemetry system according to claim 1, comprising means for transmitting an identification signal according to a time schedule, means for receiving a programming signal, and means for altering the time schedule in response to said programming signal.

11. A transmitter according to claim 10, further comprising means for wireless reception of the programming signal.

12. A transmitter according to claim 11, wherein the means for wireless reception of the programming signal comprise a resonance circuit.

13. A transmitter according to claim 12, further comprising a transistor operatively connected to said resonance circuit, which transistor is arranged for generating signal pulses upon receipt of the programming signal for altering the time schedule.

14. A transmitter according to claim 10, comprising one or more input means selected from sensors and alarm signal generators for adding information provided by said input means to said identification signal.

15. A transmitter according to claim 14, wherein said means for altering the time schedule are further arranged for altering the time schedule in dependence on the information provided by the input means.

16. A tracking and telemetry system according to claim 1 including a programming station comprising means for producing a programming signal.

17. A programming station according to claim 16, comprising means for receiving the identification signal transmitted by said at least one transmitter.

18. A method for programming a tracking and telemetry system comprising at least one transmitter and at least one receiver in which at least one transmitter is arranged for transmitting an identification signal according to a time schedule, and in which at least one receiver is arranged for receiving the transmitted identification signal, wherein a programming signal is transmitted and the time schedule is altered upon receipt of said programming signal by said at least one transmitter, and wherein said programming signal is dependent on the use conditions of said tracking and telemetry system.

* * * * *

UNITED STATES PATENT AND TRADEMARK OFFICE

CERTIFICATE OF CORRECTION

PATENT NO. : 7,061,400 B2
APPLICATION NO. : 10/759777
DATED : June 13, 2006
INVENTOR(S) : Jan Vet It is certified that error appears in the above-identified patent and that said Letters Patent is hereby corrected as shown below:

Title Page, insert

(60) --Related U.S. Application Data:

Ser. No. 10/903,985, filed on July 30, 2004, ABN.--

(30) --Foreign Application Data:

U.K. application Ser. No. 0318134.4, filed on August 1, 2003--

Signed and Sealed this

Thirteenth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,061,400 B2
APPLICATION NO. : 10/759777
DATED : June 13, 2006
INVENTOR(S) : Jan Vet It is certified that error appears in the above-identified patent and that said Letters Patent is hereby corrected as shown below:

Title Page, delete

Item (60) Related U.S. Application Data:

"Ser. No. 10/903,985, filed on July 30, 2004, ABN." (as inserted in the Certificate of Correction issued May 13, 2008)

Item (30) Foreign Application Data: delete

"U.K. application Ser. No. 0318134.4, filed on August 1, 2003" (as inserted in the Certificate of Correction issued May 13, 2008)

Item (30) Foreign Application Data should read
-- Jan. 20, 2003 (NL) ……..1022434 --

Item (73) Assignee, "Solution" should be -- Solutions --.

This certificate supersedes the Certificate of Correction issued May 13, 2008.

Signed and Sealed this

Fourteenth Day of April, 2009

JOHN DOLL
*Acting Director of the United States Patent and Trademark Office*